US006328617B1

(12) United States Patent
Gunnell

(10) Patent No.: US 6,328,617 B1
(45) Date of Patent: Dec. 11, 2001

(54) KAYAK PADDLE

(76) Inventor: Lance F. Gunnell, 1320 N. 620 E. Suite 2, Logan, UT (US) 84341

( * ) Notice: Subject to any disclaimer, the term of this patent is extended or adjusted under 35 U.S.C. 154(b) by 0 days.

(21) Appl. No.: 09/612,742

(22) Filed: Jul. 10, 2000

(51) Int. Cl.[7] ..... B63H 16/04
(52) U.S. Cl. ..... 440/101; 416/70 R; 416/74
(58) Field of Search ..... 440/101; 416/69, 416/70 R, 74

(56) References Cited

U.S. PATENT DOCUMENTS

| | | | | |
|---|---|---|---|---|
| 2,566,023 | * | 8/1951 | Gagnon | 416/74 |
| 4,926,772 | * | 5/1990 | Bright | 440/101 |
| 6,022,255 | | 2/2000 | Lukanovich | 440/101 |
| 6,027,386 | | 2/2000 | Hains et al. | 440/101 |
| 6,027,387 | | 2/2000 | Allin | 440/104 |
| 6,065,421 | | 5/2000 | Haller et al. | 114/347 |
| 6,261,141 | * | 7/2001 | Heap | 440/101 |

FOREIGN PATENT DOCUMENTS

| | | | | |
|---|---|---|---|---|
| 807 597 | * | 7/1951 | (DE) | 416/70 |
| 1.256.660 | * | 2/1961 | (FR) | 416/70 |
| 1308605 | * | 2/1973 | (GB) | 440/101 |
| 2 262 927-A | * | 7/1993 | (GB) | 440/101 |
| 1525081-A1 | * | 11/1989 | (SU) | 440/101 |

* cited by examiner

*Primary Examiner*—Sherman Basinger
(74) *Attorney, Agent, or Firm*—Madson & Metcalf

(57) ABSTRACT

A kayak paddle with improved performance features is provided. The kayak paddle includes a smaller diameter shaft than that generally used. This allows the placement of grips on the shaft. The rips have one or more finger and thumb indentations such that the kayaker can position his hand easily and securely on the kayak paddle. The grips may be rotated around the shaft in order to position them at a location which is comfortable to the user. Also provided are paddle blades which may be rotated around the shaft such that they can be positioned in the most beneficial location for the user and the particular activity. Also disclosed are structures on the blades, including ribs and compartments, which direct water flow across the blade to reduce cavitation.

36 Claims, 4 Drawing Sheets

KAYAK PADDLE

BACKGROUND OF THE INVENTION

1. The Field of the Invention

The present invention relates to improvements to paddles used in the sport of kayaking. More specifically, the present invention relates to inventive modifications to the grips, shaft, and blades of kayak paddles.

2. The Relevant Technology

Kayaking is a growing sport in the United States and throughout the world. There are a number of different types of kayaking and the boats and paddles associated therewith are designed for the particular type of activity engaged in. Thus, there are both calm water kayaks and white water kayaks along with sea or ocean kayak. For centuries, Eskimos have paddled Arctic waterways to hunt and fish in kayaks, a type of canoe built from skins stretched over a frame. Today's high-tech versions of the kayak, made from plastic, Kevlar and fiberglass, are still decked with a cockpit for the rider, who propels the boat with a double-bladed paddle.

The sport of kayaking is growing rapidly in popularity. It is believe to be second only to snowboarding in growth. Driving that growth is a recent revolution in hull design that has made doing tricks, such as wave surfing, squirts and spins, much easier. There are an estimated 1.3 million white water kayakers in the United States, 400,000 of whom can be considered "enthusiasts." One of the reasons for the increasing popularity of the sport it that a kayaking can have solitude and wilderness on the one hand and excitement on the other.

Recent developments in kayaks has fueled the increased interest in the sport. In some instances, kayak builders have followed innovations in surfboards to come up with boats that "plane," riding on top of the water instead of in the water. The boat will lift and plane.

As kayaks have improved and developed additional sports and activities are possible. Where traditional kayakers simply traveled a waterway, modem kayakers to maneuvers and tricks to improve and demonstrate their skills. To promote these types of activities, kayak rodeos are springing up around the country. Many of today's rodeo boats are specifically designed to be used in rodeos. These boats are generally small and sharply angled. These boats, however, are not ideally suited for river running in that they are too slow and don't track. Thus, "park and play" is a growing phenomenon, while down-river running is declining in popularity. This marks an radical departure from the roots of these sports, which were born from the need to get from one place to another. Thus, innovation is allowing more people to get into kayaking and to do different things on a river.

As kayak's have evolved allowing the sport to evolve, there is also a need for improvements in paddle design. Generally, a kayak paddle is comprised of an aluminum or wood shaft. The shaft is generally approximately 1.25 inches in diameter. This diameter allows the user to directly grip the paddle. There are generally no specific grips or other structures to allow the user to securely hold the paddle. At times, the user may modify his own paddles by adding tape or other wrappings to make the paddle more comfortable and usable.

Attached to each end of the shaft is a blade. The blades are specifically designed for use in kayaking. The blades are rotated with respect to each other in order to allow the kayaker to effectively dig into the water and efficiently power the kayak in the desired direction. This configuration of the blades also facilitates recent developments in kayaking, such as rodeo competitions, slalom courses, and the like.

Generally, however, the development and improvement of the paddle has not kept pace with development in the kayaks themselves. In particular, paddles are not generally adjustable. Generally, the blades are securely fixed in place on the shaft. As a result, it is not possible to adjust the position of the blade on the shaft to accommodate different preferences on the part of kayakers or different uses of the paddle.

As mentioned above, conventional kayak paddles do not include grips or other structures to allow the user to grasp the paddle. Generally, the user simply grasps the shaft itself. In some environments and for some uses it would be an improvement to provide grips on the shaft of the paddle. It would also be helpful to provide grips which could be rotated and adjusted for individual preferences and for different uses of the paddles.

Another problem that is often encountered is that the paddle is pushed backward into the kayaker was the kayaker travels through rough white water or in the event the paddle strikes a solid object such as a rock. Accordingly, it would be an advancement in the art to provide a safety pad on the shaft of the paddle. If would be a further advancement to provide such a pad which was less dense than water such that it would help with floatation of the paddle.

These and other advantages and improvements are provided by the present invention.

OBJECTS AND BRIEF SUMMARY OF THE INVENTION

The apparatus of the present invention has been developed in response to the present state of the art, and in particular, in response to the problems and needs in the art that have not yet been fully solved by currently available kayak paddles. Thus, it is an overall objective of the present invention to provide a kayak paddle which responds to the limitations encountered in existing kayak paddles. Particularly, it is an object of the present invention to provide a kayak paddle which will be useable in the various developing environments for kayaking, including white water kayaking, rodeo, slalom, sea kayaking, and touring.

Another important object of the present invention is to provide a kayak paddle in which the position of the blades is adjustable around the longitudinal axis of the shaft.

Yet another object of the present invention is to provide a kayak paddle which has hand grips, which hand grips are also adjustable about the longitudinal axis of the shaft.

An additional object of the present invention is to provide a kayak paddle which includes blades which include flow modifying structures disposed on the exterior surface of the blades, such flow modifying structures taking various forms including ribs or hexagonal compartments formed on the blade surface.

A further object of the present invention is to provide a kayak paddle which includes a safety and floatation pad disposed at an intermediate point on the shaft of the paddle.

To achieve the foregoing objects, and in accordance with the invention as embodied and broadly described herein in the preferred embodiment, a kayak paddle is provided. The kayak paddle comprises a shaft having a longitudinal axis and having a first end and second end. The shaft is significantly smaller in diameter than a conventional shaft. Generally, the shaft of the present invention will be in the range of from about 0.75 to 1.00 inch. This allows the placement of hand grips on the shaft as will be discussed more fully below. In view of the smaller diameter of the shaft it is also preferable to construct the shaft from a material other than the conventional aluminum used in kayak paddles. It is generally preferable to use a carbon composite material, or other similar material suitable for use as the shaft of a kayak paddle.

The kayak paddle also includes blades. A first blade is attached to the first end of the shaft and a second blade attached to the second end of the shaft. In one embodiment of the present invention it is preferred that the blades be attached to the shaft by a releasable attachment mechanism such that said blades are capable of being rotated about the longitudinal axis of the shaft. To facilitate the rotation of the blades about the longitudinal axis of the shaft, the blades are attached by any one of a number of well known attachment mechanisms including a set screw or clamp.

In certain embodiments, the blades may have one more structures disposed on the exterior surface. These structures are configured such that during use of the kayak paddle, water is channeled along the surface of the blades and the level of cavitation along the blade surface is reduced. In one embodiment the structures include ribs. It is also possible to form compartments on the surface of the blade for accomplishing the same general result. In certain embodiments of the invention the compartments are generally hexagonal in their exterior cross section. Such hexagonal compartments are designed such that they are also capable of providing floatation to the paddle. In any event, the structures, whether they take the form of ribs or hexagonal compartments, result in a reduction of cavitation along the paddle surface. This provides additional control over the paddle during use. It also allows the user to paddle more vigorously and powerfully without experiencing feathering or flutter along the paddle surface.

In certain further embodiments of the invention, it is also preferable that the blades be contoured such that they can pass along the side of the kayak without contacting and damaging the kayak. In that regard, the present invention also includes blades which are contoured and include a cut-out or indented section which corresponds generally to the contour of the kayak. Generally such a blade will include an indentation in its upper surface configured such that it generally corresponds to the outside diameter of a kayak.

As mentioned above, in certain embodiments of the present invention at least one grip, and preferably a pair of grips, are disposed about the shaft at a point intermediate between the first and second blades. Since the shaft has a smaller diameter than a conventional kayak paddle, it is possible to add the hand grips around the shaft. The grips preferably include at least one finger notch. In certain embodiments of the device the grip may have finger notches for all of a user's fingers.

It is also important that the grip have smooth, rounded surfaces over its entire area. This allows the user to locate the proper position and hold the grip without injury or irritation. Finally, in certain embodiments it will be preferred that the grips correspond in length to the length of the user's hand. In this way there is no question as to the proper place to grasp the grip. This overcomes problems encountered in the art where the user is unable to accurately gauge where the paddle should be held, especially in situations which require quick action.

As with the blades, in certain embodiments of the device it will be beneficial to allow the grips to be rotated around the longitudinal axis of the shaft. In this manner it is possible for the user to adjust the location of the grips to fit the user's preferences. In addition, it may be desirable for the user to adjust the location of the grips depending on the type of activity engaged in. It is likely that the grip location will be different for a kayak rodeo activity than it would be for cruising in calm water. Thus, a set screw, latch, or other conventional latching mechanism may be provided to allow the grips to be positioned at various positions with respect to the remainder of the paddle.

In certain embodiments of the present invention it is beneficial to provide a pad which is disposed about at least a portion of the surface of the shaft at a location intermediate between said two grips. The pad is comprised of a material less dense than water, such as a polymer foam material. The pad provides multiple benefits. First, the pad is a safety feature. White water and rodeo kayaking are very vigorous activities. It is not unusual for the paddle to be pushed into the kayaker. If the paddle hits the kayaker in the face, for example, it is likely that an injury will occur. The pad reduces or prevents injury in this type of situation. In addition, the pad provides additional floatation for the paddle. This is important if the paddle is dropped into the water.

Thus, the present invention provides improvements to conventional kayak paddles and these and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
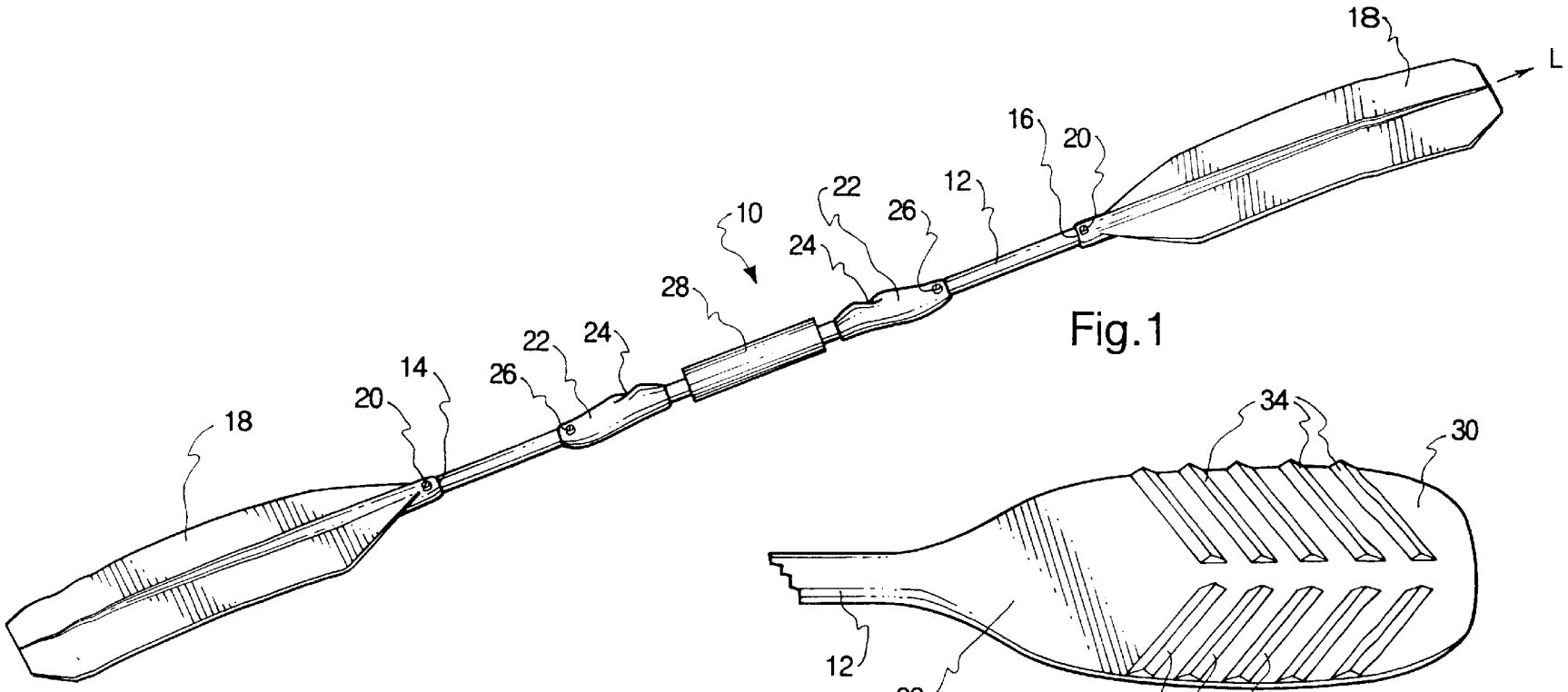
FIG. 1 is a perspective drawing illustrating one embodiment of the kayak paddle of the present invention.

The present invention can be better understood with reference to the drawings where like parts are designated with like numerals throughout. As illustrated in FIG. 1, the present invention relates to an improved kayak paddle 10. As discussed above, the sport of kayaking has recently advanced rapidly. Advancements in kayak construction have opened new opportunities for kayaking and have diversified the types of activities that can be undertaken in a kayak. As a result, there is a need in the art for improvements to the conventional kayak paddle to further facilitate advancement of the sport of kayaking. The present invention is related to providing such advancements in the design and construction of kayak paddles.

FIG. 1 is a perspective view of a kayak paddle 10 falling within the scope of the present invention. The kayak paddle includes an elongated shaft 12. The shaft is elongated and generally cylindrical in configuration. The shaft has a longitudinal axis designed "L" in FIG. 1. The shaft has first and second ends, 14, 16 respectively. As mentioned above, the shaft 12 of the present invention is somewhat reduced in diameter. Generally, the shaft will have a diameter from about 0.75 inches to about 1.0 inches. In order to provide for strength, flexibility, and general light weight, various types of materials may be employed. However, in one preferred embodiment of the present invention, the shaft is constructed of a carbon fiber composite material. The shaft may be of any length desired. Paddles of various lengths may be desired for various kayaking environments.

Attached at the first and second ends 14, 16 are a pair of blades 18. As illustrated in FIG. 1, the blades 18 may have a generally conventional configuration. The blades are formed such that they allow efficient operation in a kayaking environment. The blades may be constructed of any suitable material. The blades may be made of conventional plastic materials, or they may be made of materials such as carbon-nylon. In certain embodiments it may be desirable to construct the blades of a flexible material such as Lexan.

The blades 18 may be made such that they are solid material throughout. Alternatively, in certain embodiments, it may be desirable to provide additional floatation. In such embodiments, it is possible to mold the blades such that they have an air space molded into the center of the blade. In certain embodiments, it may be desirable to fill such a molded space with a light material such as a polyester foam, or similar material. In this manner, additional floatation may be provided to the paddle by the manner of construction of the blades.

It is conventional for the blades of kayak paddles to be securely attached to the shaft at a predetermined angle with respect to one another. This arrangement, however, fails to compensate for individual preferences and for different kayaking environments. Therefore, the present invention teaches rotatably mounting the blades 18 on the shaft 12. This may be accomplished by any type of rotatable mounting mechanism. In one embodiment, the mechanism simply requires the use of set screws 20. The set screws 20 may be tightened or loosened. When the set screws 20 are loosened, the blades 18 may be rotated about the longitudinal axis L. Once the blades 18 are placed in the desired position, the set screws 20 are tightened and the blades 18 are locked in place. This allows the kayaker to position the blades at locations which best suit they needs and strengths of the particular kayaker.

FIG. 1 also illustrates a pair of grips 22 disposed about the shaft. In view of the fact that the shaft 12 is smaller in diameter than conventional shafts, it is possible to position at least one grip 22 around the outside of the shaft 12, while still allowing the kayaker to easily and comfortably grasp the grip 22.

As illustrated in FIG. 1, the grips 22 have a single finger indentation 24 which aids the kayaker in maintaining a secure grasp of the paddle. In alternative embodiments, including the embodiment illustrated in FIG. 6, it may be desirable to provide additional finger indentations. Thus, the present invention teaches the use of up to four finger indentation and a location for the thumb of the hand.

The grips may be made of any type of material generally used for this and similar purposes. Various types of plastics and rubbers may be used. It is generally preferred that the grips 22 be constructed of a pliable rubber material in order to provide a comfortable grasp of the kayak paddle 10.

As with the blades 18, is may be desirable to adjust the location of the grips 22 to accommodate different users and different activities by the same user. Accordingly, in some embodiments of the present invention it is desirable to provide a mechanism for rotating the grips 22 about the longitudinal axis L of the shaft. As with the blades 18, any conventional mechanism may be employed to releasably secure the grips 22 to the shaft 12. One inexpensive and effective mechanism is, once again, a simple set screw mechanism. Alternatively, various types of clamps or other mechanisms could be employed to releasably secure the grips 22 in place on the shaft 12. FIG. 1 illustrates set screws 26 which secure the grips 22 in place on the shaft 12.

Also illustrated in FIG. 1 is a pad 28. The pad 28 provides multiple functions in the overall operation of the paddle 10. The pad 28 will likely be constructed of material that this less dense than water and, therefore, provides additional floatation to the paddle 10. In addition, the pad 28 can provide an important safety function. Kayaking, especially white water kayaking, is a very vigorous sport. It is not unusual to encounter rough water or other obstacles that fling the paddle backward into the kayaker. It is not unusual for the kayaker to be struck in the head with his own paddle. Accordingly, the pad 28 provides additional protection to the kayaker at the location on the shaft most likely to impact the kayaker. Generally, that location is intermediate between the two grips 22.

Figure 2:
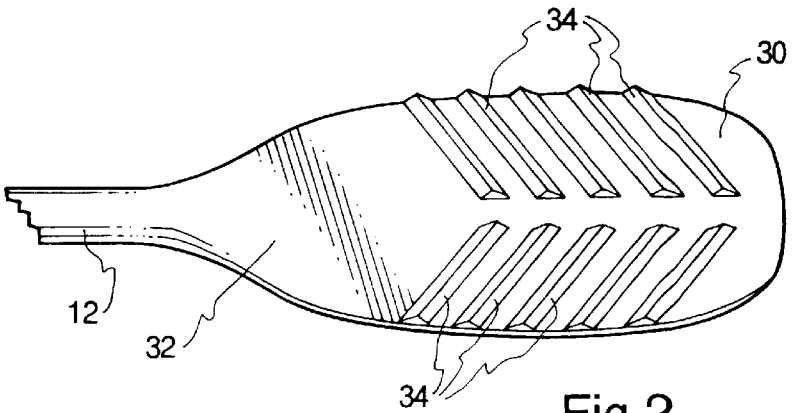
FIG. 2 is a plan view of a one embodiment of the paddle blades of the kayak paddle having ribs disposed on the surface of the blade.

FIG. 2 illustrates an alternative embodiment of the blades. The illustrated embodiment of the blade in FIG. 2 is designated 30. FIG. 2 illustrates a shaft 12 which similar in construction to the shaft illustrated in FIG. 1.

In certain embodiments it will be preferable to provide water flow control on the surface 32 of the blade 30. Without flow control on the surface blades have been known to "flutter" or "feather" in the water. That is, they do not operate in a stable and effective manner. Rather they experience cavitation at the blade surface which interferes with the blade operation.

FIG. 2 illustrates one solution for blade cavitation. In the illustrated embodiment a series of ribs 34 is provided on the working surface of the blade 30. As illustrated in FIG. 2, the ribs 34 direct the flow of water over the blade surface. The directed flow results in reduced cavitation along the surface of the blade. This in turn results in reduced feathering or fluttering of the blade during use. The overall effect is to provide the kayaker with more control and power.

Figure 3:
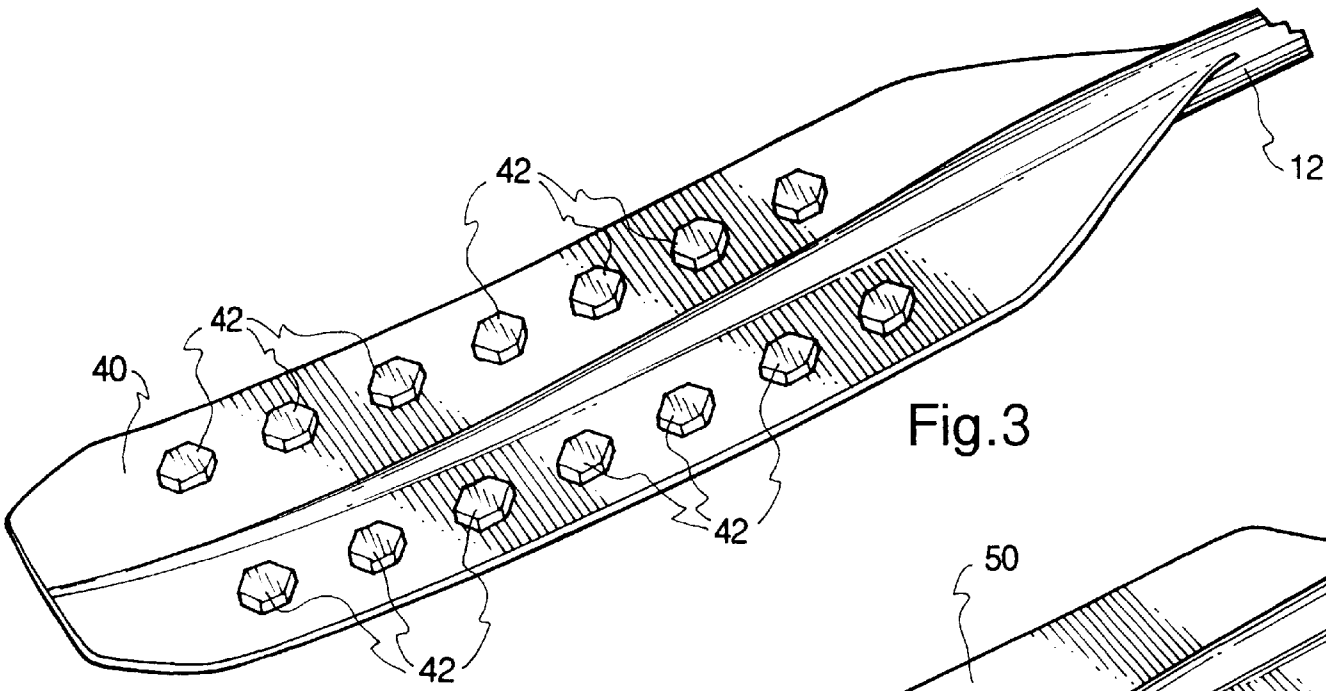
FIG. 3 is a plan view of an alternative embodiment of a paddle blade having hexagonal compartments formed in the surface of the blade.

FIG. 3 illustrates an alternative embodiment of a blade 40. Blade 40 is also attached to shaft 12 as discussed elsewhere. As illustrated in FIG. 3, the blade 40 includes a plurality of compartments 42 formed on the blade surface. In this particular embodiment, the compartments 42 are generally hexagonal in cross section. Compartments of different shapes and sizes could also be employed. Square, round, triangular, octaganonal, etc. compartments could also be used in certain circumstances.

The compartments 42 perform essentially the same function as the blades 30 described in FIG. 2. In addition, however, compartments 42 may be hollow such that they provide air pockets in the interior of the blade. Alternatively, the compartments 42 may be filled with a foam or other suitable material. In any event, in addition to providing flow control along the blade surface, it is also possible for the compartments to provide additional floatation to the paddle.

Figure 4:
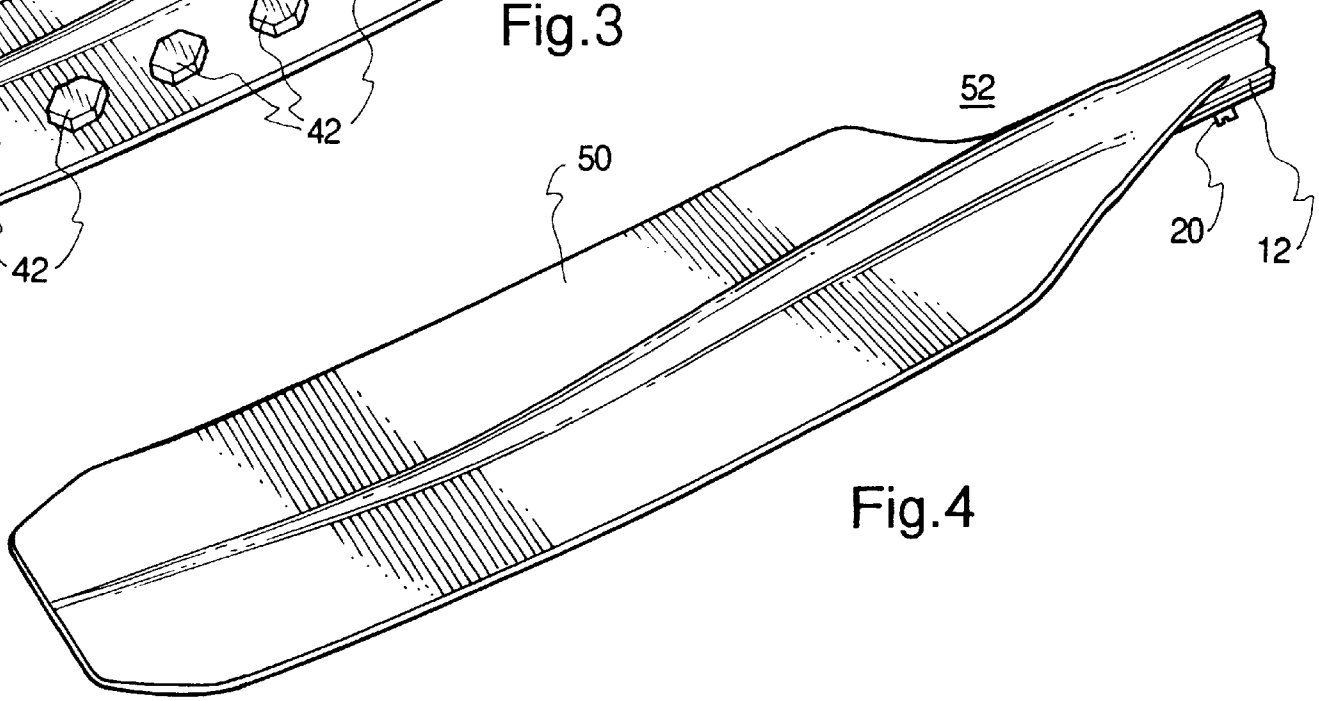
FIG. 4 is a plan view of a further embodiment of the blade of the present invention illustrating a cut-out indentation in its upper edge which corresponds generally to the contour of a kayak.

FIG. 4 illustrates an further embodiment of a blade 50. As described above, the blade 50 is attached by means of a set screw 20. The set screw 20 operates in the manner described above.

The blade 50 includes a noticeable cut-out or indentation 52. In some uses of a kayak paddle it is necessary for the kayaker to vigorously paddle across the front portion of the kayak. During this vigorous paddling, and even in more routine paddling, it is not unusual for the paddle to strike the kayak. The embodiment of the blade illustrated in FIG. 4 minimizes the potential for contact between the kayak and blade by forming an indentation 52 in the blade 50 which corresponds generally to the contour of the kayak. By including such an indentation in the blade it is possible to largely avoid undesirable contact between the kayak and the blade, thus making the operation of the kayak more efficient and reducing the chance of damage to both the kayak and the blade.

Figure 5:
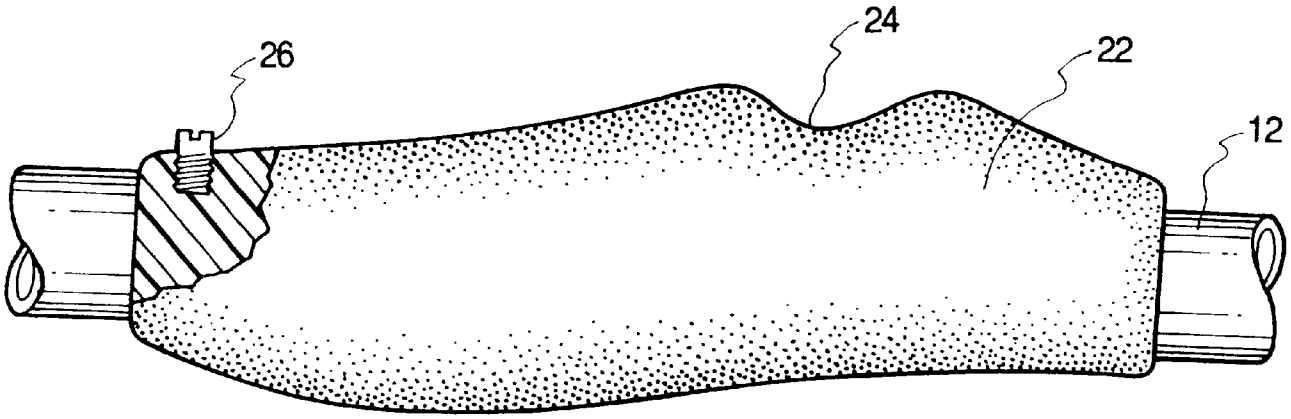
FIG. 5 is a perspective view of one embodiment of the grip of the present invention illustrating a single finger notch and a set screw for releasably securing the grip to a shaft.
Figure 6:
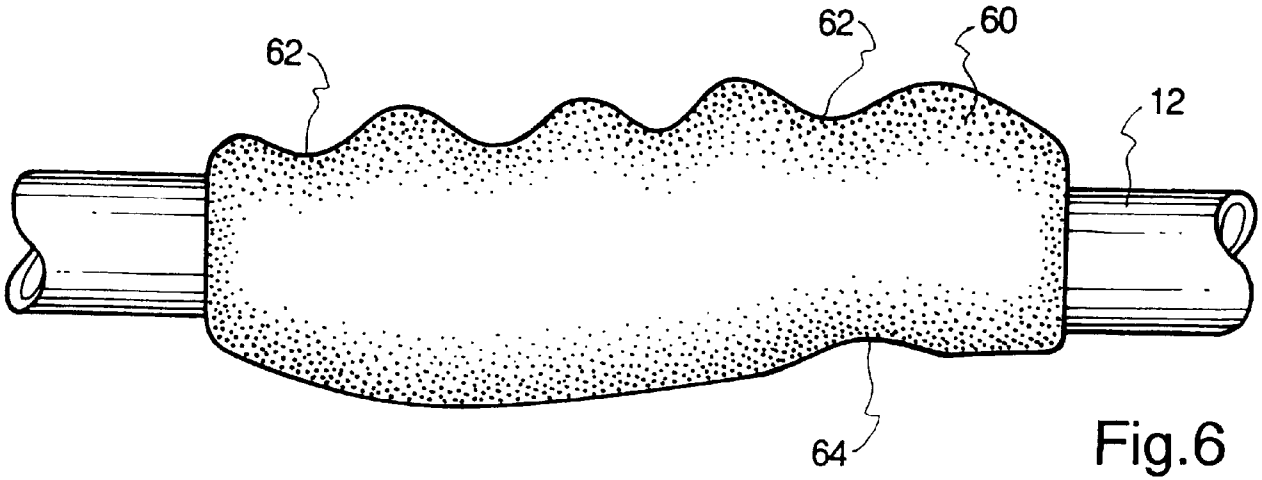
FIG. 6 is a perspective view of a further embodiment of the grip of the present invention illustrating a shortened length which approximates the length of the hand of a user and which grip has four finger notches.
Figure 7:
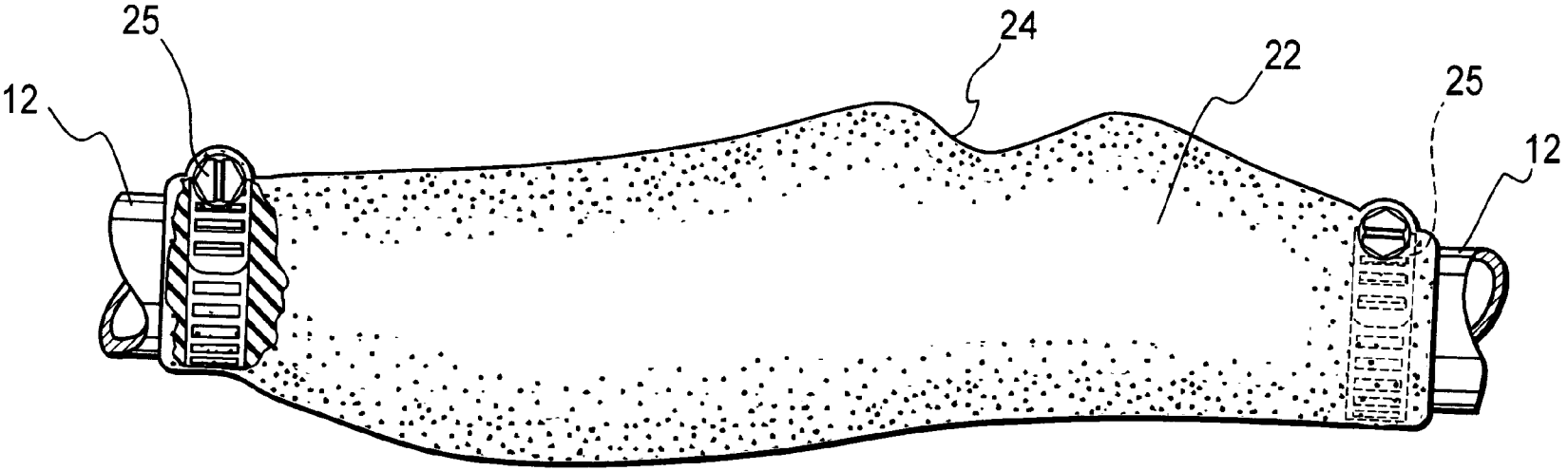
FIG. 7 is a perspective view of one embodiment of the grip of the present invention illustrating a single finger notch and a clamp for releasably securing the grip to a shaft.

FIGS. 5 and 6 illustrate in additional detail two embodiments of the grips of the present invention. FIG. 5 illustrates a grip 22 essentially as shown in FIG. 1. The grip is placed over the outside diameter of the shaft 12 in the manner illustrated. It will be appreciated from the Figures that the grip 22 has rounded, smooth exposed surfaces. This is in contrast to other types of grips, such as those often used on ski poles, and the like. The smooth rounded surfaces of the grip 22 helps assure that the kayaker can grasp the grip 22 comfortably. This feature also allows the kayaker to slide his hand along the shaft 12 and find the grip 22, without fear of a painful collision with an abrupt edge. This is important in kayaking because it is not unusual for the kayaking to loose a grip on the paddle, or to be required to slide his hand only the shaft to re-grip the paddle.

As discussed above, the grip 22 also includes a finger indentation 24. The indentation provides the user with more comfortable gripping of the paddle. It also signals the proper location for holding the paddle. This is important when attempting to re-grip the paddle while the kayaker's vision may be impair by splashing water or other obstruction.

FIG. 6 illustrates a modified embodiment of the grip 60. This grip 60 has multiple features not included in the grip 22 previously described. The grip 60 is attached to the shaft 12 in the same general manner. It is also possible to attach the grip 60 with a set screw in the manner illustrated in FIG. 5.

The grip 60 includes a series of four finger notches 62. This allows the user to grasp the grip 60 with the entire hand and to have a specific location for each finger. In this manner the kayaker can be assured that his hand is located in the appropriate location on the grip 60. As illustrated in FIG. 6, the grip is also shorter than the grip 22 illustrated in FIG. 5. Once again, the shorter length removes any ambiguity the kayaker may feel as to where to appropriately grasp the grip 60.

In summary, the apparatus of the present invention has been developed in response to the present state of the art, and in particular, in response to the problems and needs in the art that have not yet been fully solved by currently available kayak paddles. The present invention responds to the limitations encountered in existing kayak paddles. The present invention provides a kayak paddle which will be useable in the various developing environments for kayaking including white water kayaking, rodeo, slalom, sea kayaking, and touring. The present invention also provides a kayak paddle in which the position of the blades is adjustable around the longitudinal axis of the shaft. Furthermore, the present invention provides a kayak paddle which has hand grips, which hand grips are also adjustable about the longitudinal axis of the shaft. The present invention provides a kayak paddle which includes blades which include flow modifying structures disposed on the exterior surface of the blades, such flow modifying structures taking the form of ribs or hexagonal compartments formed on the blade surface. In addition, the present invention provides a kayak paddle which includes a safety and floatation pad disposed at an intermediate point on the shaft of the paddle.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. A kayak paddle, comprising:

a shaft having a longitudinal axis and having a first end and second end;

a first blade attached to the first end of said shaft and a second blade attached to the second end of said shaft, said blades being attached to the shaft by a releasable attachment mechanism such that said blades are capable of being rotated about the longitudinal axis of the shaft and secured to the shaft at a plurality of selected locations about the longitudinal axis of the shaft;

at least one grip disposed about said shaft at a point intermediate between said first and second blades, said at least one grip being attached to the shaft by a releasable attachment mechanism such that said grip is capable of being rotated about the longitudinal axis of the shaft and secured to the shaft at a plurality of selected locations about the longitudinal axis of the shaft;

wherein the blades and the grips are individually positionable at a personalized user orientation.

2. A kayak paddle as defined in claim 1 wherein said shaft has a diameter in the range of from about 0.75 to 1.00 inch.

3. A kayak paddle as defined in claim 1 wherein at least one of said releasable attachment mechanisms comprises a set screw.

4. A kayak paddle as defined in claim 1 wherein at least one of said releasable attachment mechanisms comprises a clamp.

5. A kayak paddle, comprising:

a shaft having a longitudinal axis and having a first end and second end;

a first blade attached to the first end of said shaft and a second blade attached to the second end of said shaft;

at least one grip disposed about said shaft at a point intermediate between said first and second blades, said at least one grip being attached to the shaft by a releasable attachment mechanism such that said grip is capable of being rotated about the longitudinal axis of the shaft and then secured to the shaft at a plurality of selected locations, such that the at least one grip is individually positionable at a personalized user orientation, and wherein said grip further comprises at least one finger notch and wherein the surfaces of the said grip are generally rounded.

6. A kayak paddle as defined in claim 5 comprising a pair of grips disposed about said shaft.

7. A kayak paddle as defined in claim 6 further comprising a pad disposed about at least a portion of the surface of the shaft.

8. A kayak paddles as defined in claim 7 wherein the pad is comprised of a material less dense than water.

9. A kayak paddle as defined in claim 7 wherein the pad is disposed about the shaft at a location intermediate between said two grips.

10. A kayak paddle as defined in claim 5 said grip having more than one finger notch.

11. A kayak paddle as defined in claim 5 said grip having four finger notches.

12. A kayak paddle as defined in claim 5 wherein said grip is configured such that the length of the grip corresponds substantially to the length of a hand holding said grip.

13. A kayak paddle, comprising:

a shaft having a longitudinal axis and transverse axis and having a first end and second end;

a first blade attached to the first end of said shaft and a second blade attached to the second end of said shaft said blades having a plurality of structures disposed on the exterior surface of the blades said structures configured such that during use of the kayak paddle water is channeled along the surface of the blades by said structures and the level of cavitation along the blade surface is reduced.

14. A kayak paddle as defined in claim 13 further comprising at least one grip disposed about said shaft at a point intermediate between said first and second blades, wherein said grip further comprises at least one finger notch.

15. A kayak paddle as defined in claim 13 wherein said structures comprise ribs.

16. A kayak paddle as defined in claim 13 wherein said structures comprise compartments formed on at least one surface of the blade.

17. A kayak paddle as defined in claim 16 wherein said compartments are generally hexagonal in their exterior cross section.

18. A kayak paddle as defined in claim 16 wherein said compartments are configured such that they provide additional floatation to the paddle.

19. A kayak paddle as defined in claim 16 wherein said compartments are configured such that they direct the flow of water along the paddle surface and result in a reduction of cavitation along the paddle surface.

20. A kayak paddle as defined in claim 13 wherein said blades are releasably secured to said shaft and capable of being rotated about the longitudinal axis of the shaft.

21. A kayak paddle as defined in claim 13 further comprising a mechanism for releasably securing said blade in position with respect to the transverse axis.

22. A kayak paddle as defined in claim 21 wherein said mechanism comprises a set screw.

23. A kayak paddle as defined in claim 13 wherein at least one of said blades is configured such that it includes an indentation in its upper surface configured such that it generally corresponds to the outside diameter of a kayak.

24. A kayak paddle, comprising:

shaft having a diameter in the range of from about 0.75 to 1.00 inch, said shaft having a longitudinal axis and having a first end and second end;

a first blade attached to the first end of said shaft and a second blade attached to the second end of said shaft, said blades being attached to the shaft by a releasable attachment mechanism such that said blades are capable of being rotated about the longitudinal axis of the shaft and secured to the shaft at a plurality of selected locations about the longitudinal axis of the shaft;

at least one grip disposed about said shaft at a point intermediate between said first and second blades, said at least one grip being attached to the shaft by a releasable attachment mechanism such that said at least one grip is capable of being rotated about the longitudinal axis of the shaft and secured to the shaft at a plurality of selected locations about the longitudinal axis of the shaft said grip further comprising at least one finger notch;

wherein the blades and the grip are individually positionable at a personalized user orientation.

25. A kayak paddle as defined in claim 24 wherein at least one of said releasable attachment mechanisms comprises a set screw.

26. A kayak paddle as defined in claim 25 wherein at least one of said releasable attachment mechanisms comprises a clamp.

27. A kayak paddle as defined in claim 24 comprising a pair of grips disposed about said shaft.

28. A kayak paddle as defined in claim 27 said grips having four finger notches.

29. A kayak paddle as defined in claim 24 further comprising a pad disposed about at least a portion of the surface of the shaft.

30. A kayak paddles as defined in claim 29 wherein the pad is comprised of a material less dense than water.

31. A kayak paddle as defined in claim 24 wherein said blades having a plurality of structures disposed on the exterior surface of the blades and configured such that during use of the kayak paddle, water is channeled along the surface of the by said structures and the level of cavitation along the blade surface is reduced.

32. A kayak paddle as defined in claim 31 wherein said structures comprise ribs.

33. A kayak paddle as defined in claim 31 wherein said structures comprise compartments formed on at least one surface of the blade.

34. A kayak paddle as defined in claim 33 wherein said compartments are generally hexagonal in their exterior cross section.

35. A kayak paddle as defined in claim 33 wherein said compartments are configured such that they provide additional floatation to the paddle.

36. A kayak paddle as defined in claim 24 wherein at least one of said blades is configured such that it includes an indentation in its upper surface configured such that it generally corresponds to the outside diameter of a kayak.

* * * * *